United States Patent [19]

Fischer

[11] Patent Number: 4,493,255

[45] Date of Patent: Jan. 15, 1985

[54] MULTI-STATION SHEET ROTARY OFFSET PRINTING MACHINE

[75] Inventor: Hermann Fischer, Augsburg, Fed. Rep. of Germany

[73] Assignee: M.A.N.—Roland Druckmaschinen Aktiengesellschaft, Offenbach am Main, Fed. Rep. of Germany

[21] Appl. No.: 460,498

[22] Filed: Jan. 24, 1983

[30] Foreign Application Priority Data

Feb. 5, 1982 [DE] Fed. Rep. of Germany ..... 3203879

[51] Int. Cl.[3] ..... B41F 7/02; B41F 21/10

[52] U.S. Cl. ..... 101/183; 101/232; 101/177

[58] Field of Search ..... 101/177, 183, 181, 137, 101/232, 246

[56] References Cited

U.S. PATENT DOCUMENTS

| | | | |
|---|---|---|---|
| 1,875,869 | 9/1932 | Hence | 101/137 |
| 3,384,011 | 5/1968 | Bolza-Schunemann | 101/177 |
| 3,949,690 | 4/1976 | Katsuji | 101/177 |
| 4,365,553 | 12/1982 | Fischer et al. | 101/232 |
| 4,409,895 | 10/1983 | Fischer | 101/248 |

FOREIGN PATENT DOCUMENTS

| | | | |
|---|---|---|---|
| 2217514 | 8/1973 | Fed. Rep. of Germany | 101/183 |

*Primary Examiner*—William Pieprz

*Attorney, Agent, or Firm*—Frishauf, Holtz, Goodman & Woodward

[57] ABSTRACT

To permit modular construction of a multiple sheet-fed rotary offset printing machine, for selective multi-color prime and/or verso printing, printing stations are constructed to position the blanket cylinders (17–20, 59–62) and the printing cylinders (21–23; 59–66) in alternate contacting position along a straight line, the printing cylinder (e.g. 22) of one printing station (e.g. 2) being, alternately, in engagement with the blanket cylinder (19) of an adjacent station (3). The printing and blanket cylinders all have grippers, and the printing cylinders of one station applying prime printing may have a rubber blanket thereon and form the blanket cylinder of a station (32) located beneath the respective printing station. A theoretical connecting line connecting the axes of the blanket cylinders and printing cylinders of the respective station has a zig-zag configuration, with angles between the respective portions or legs of the line being between 70°–175°, preferably about 145°. The dimensions of the respective printing and blanket cylinders are preferably twice that of the plate cylinders, to provide suitable access for maintenance and operating personnel between the respective stations with reasonable size of the machine.

20 Claims, 2 Drawing Figures

MULTI-STATION SHEET ROTARY OFFSET PRINTING MACHINE

Reference to related application, by the inventor hereof and assigned to the assignee of the present application: U.S. Ser. No. 460,408, filed Jan. 24, 1983, Fischer.

The present invention relates to a sheet rotary offset printing machine system, in which a plurality of offset printing stations are joined together to permit, sequentially, multiple prime or prime and verso printing, and which is so constructed that the respective printing stations are identical, or nearly identical, so that the printing capability of the system can be arranged in accordance with customer requirements and can be readily expanded with identical units, if desired.

BACKGROUND

Various types of multi-station printing machines are known; in one such arrangement, a three-cylinder printing station provides for transport of sheets between two printing stations by one or more transfer drum, or by a transfer chain system. An arrangement of this type is shown, for example, in the publication "Einfuehrung in den Offsetdruck" ("Introduction to Offset Printing") by Walenski, pages 48, 49. Similarly, four-cylinder printing stations can be connected together, in which each of the two blanket cylinders simultaneously takes on the function of the printing or impression cylinder for another blanket cylinder. Consequently, such an arrangement permits, in one path, prime and verso printing—see, for example, German Pat. No. 960,994. Known systems for sheet transport thus are required between the printing stations, which increases the manufacturing costs and complexity of such systems.

THE INVENTION

It is an object to provide a multi-station printing machine system for rotary offset sheet printing, in which requirements for components for sheet transport are reduced and which can be constructed in modular form.

Briefly, the blanket cylinders and printing cylinders—which may be blanket cylinders of an adjacent station—are all equipped with sheet grippers. The blanket cylinders and printing cylinders are located in alternatingly contacting position, so that the blanket cylinder of one station contacts the printing cylinder of another station—it being remembered that the printing cylinder of another station may be its blanket cylinder which, then, in turn will be in contact with a further blanket cylinder of a next subsequent printing station. The printing cylinders and the blanket cylinders are so arranged that a theoretical connecting line of their axes or rotation has a zig-zag form, with the respective legs or portions of the connecting line being angled with respect to each other by angles of between about 70° to 150°, preferably obtuse angles, for example of about 100° to 150°. The printing cylinder of one station is, alternately, in engagement with the blanket cylinder of an adjacent station. Sheet transport between the stations, thus, can be effected by the respective grippers on the respective cylinders.

The arrangement of the respective blanket cylinders and the printing or impression cylinders—which may, in themselves, be blanket cylinders—substantially decreases the requirement of transport elements. Additionally, the overall length of the machine system can be reduced. The machine system can be readily expanded, based on customer requirements, to print any desired number of prime printing impressions, with multiple colors. The arrangement has the further advantage that in a very simple manner—with a minimum of parts—one or more prime printing units can be associated with verso printing units, so that the machine can operate both as a multi-station prime printing system or a multi-station prime-and-verso printing system, which is expandable as required. Basically, the arrangement permits a modular construction without, however, requiring additional sheet transport or connecting elements for the respective modules formed by the respective printing stations providing, as required, prime or prime-and-verso printing capability.

DRAWINGS

FIG. 1 is a schematic side view of an offset sheet rotary printing machine system for four-color prime printing and single-color verso printing; and FIG. 2 is a side view similar to FIG. 1, providing for four-color prime printing and four-color verso printing.

DETAILED DESCRIPTION

Figure 1:
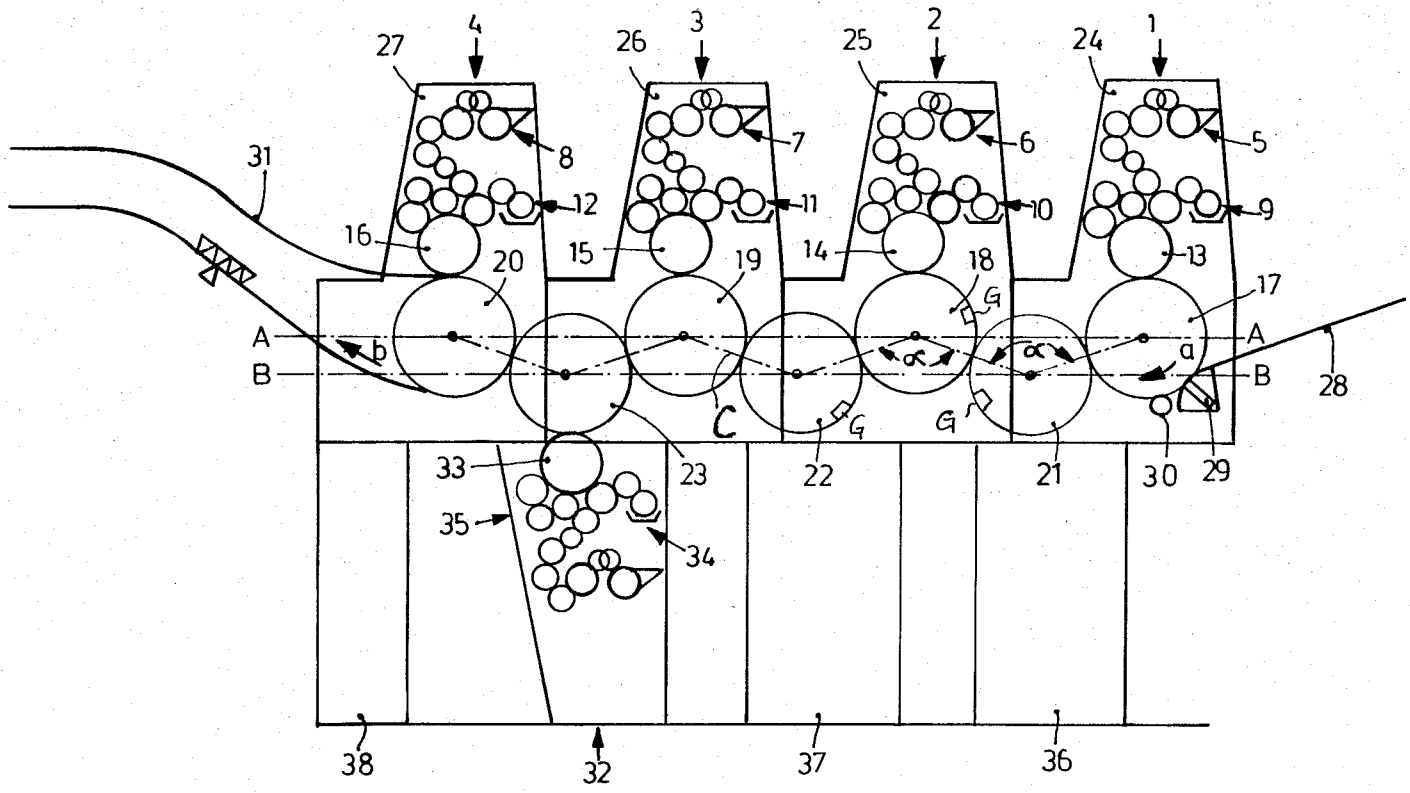

The machine of FIG. 1 has four printing stations 1, 2, 3, 4, each formed as separate modules. Each of the printing stations 1–4 includes an inker 5, 6, 7, 8, a damper 9, 10, 11, 12, a plate cylinder 13, 14, 15, 16 and a blanket cylinder 17, 18, 19, 20. The printing systems 1–4 are arranged for prime printing. Each one of the modules of the printing systems 1–3 has, additionally, an impression or printing cylinder 21, 22, 23. The prime printing module of station 4 does not require such a printing or impression cylinder, since it is not needed for printing therein. All modules of the prime printing stations 1–4, otherwise, are identically constructed, and even the module of printing station 4, preferably, is identical to printing stations 1–3, with only the impression cylinder left off. Thus, the side walls 24–27 of the modules forming printing stations 1–4 are identical; they can be directly connected together in any suitable manner. The blanket cylinders 17–19 and the printing or impression cylinders 21–23 all contain grippers for sheet transport, in accordance with any suitable construction. Impression cylinder 23 cooperates with both blanket cylinders 19 and 20 of stations 3 and 4 and thus forms the impression cylinder for both the printing stations or modules 3 and 4. Only one such gripper is shown at G schematically on the cylinders 21, 22, for clarity of illustration. Further, the respective blanket cylinders, each, have the usual and customary arrangements to clamp a rubber blanket over the circumference of the respective blanket cylinders.

In the example selected, the diameters of the blanket cylinders 17 to 20, as well as the diameters of the impression or printing cylinders 21 to 23, are all the same; the diameters of the blanket and printing cylinders, respectively, are twice the diameter of the plate cylinders 13 to 16. The bearings for the blanket and impression cylinders 17 to 23 are so arranged that the axes of the blanket cylinders 17 to 20 are in a theoretical plane, illustrated in chain-dotted lines A—A; the axes of the printing cylinders 21–23 are in a second theoretical plane B—B. The planes A—A and B—B, preferably, are horizontal, so that the sheets can be fed in customary manner from one end side of the machine, over a make-ready table and sheet supply apparatus feeding the sheets thereto. The distance between the two planes A and B is so arranged that a theoretical connecting line C, shown in chain-dotted representation, between the axes of the blanket cylinders 17–20 and the respectively adjacent printing cylinders 21–23, forms a zig-zag configuration. The respective legs or connecting portions between the zig-zag configuration include an angle $\alpha$ of, preferably, about 145°. This angle may vary widely, however, and preferably is obtuse, within a range of between 100°–150°; an acute angle, however, may also be used, and the angular range may be selected between about 70° to 175°. Making the angle $\alpha$ smaller decreases the length of the printing machine system, decreasing, however, also the distance between the plate cylinders, and consequently the inkers and dampers of adjacent printing stations. Decreasing this angle, thus, results in increasingly difficult access to the respective components of the printing stations of the machine system. Consequently, access for servicing, cleaning, and the like, to the respective stations and components of the machine can be improved by increasing the angle $\alpha$.

Access to the inkers and dampers and the plate cylinders, as well as the length of the machine, are additionally determined by the diameter of the plate cylinders, blanket cylinders, and printing cylinders. In a preferred form, the three cylinders necessary for any printing station, blanket cylinder, printing cylinder and plate cylinder, can be so designed that they are all of equal size. Yet, the circumference of the plate cylinder is preferably so selected that a plate can be clamped thereover. This configuration is preferred for small-format, narrow machines. In a preferred form, in which a good compromise is achieved between machine length and accessibility, the diameter of the blanket cylinders 17–20 and of the printing cylinders 21–23 is selected to be twice the diameter of the plate cylinders 13–16. Of course, it is also possible to so design the blanket cylinder and/or the printing cylinder that the diameter of the respective cylinder is a whole number multiple of the diameter of the plate cylinder and of any other cylinder necessary for printing.

In the example shown, the printing stations 1–4 provide for prime printing of sheets supplied over a make-ready table 28. The make-ready table 28 supplies the sheets to transfer grippers 29. To insure that the position in which the blanket cylinder 17 grips the sheets, by receiving them from the grippers 29, and to prevent smearing by loose engagement of the sheet when it reduces the printing line between the blanket cylinder 17 and the printing cylinder 21, an engagement roller 30 is provided to press the sheets against the circumference of the blanket cylinder 17 and provides for smooth, snug engagement therewith. The engagement roller 30 is located just downstream of the transfer grippers 29. The direction of rotation of the first blanket cylinder 17 is shown by the arrow a. The engagement roller 30 presses the sheet against the circumference of the blanket cylinder so that it will fit smoothly on the circumference of the blanket cylinder 17, which already has been inked.

The sheet is transferred from the grippers of the blanket cylinder 17 to the grippers of the printing cylinder 21, then to the grippers of blanket cylinder 18, then to the grippers of printing cylinder 22, then to the blanket cylinder 19, and to the printing cylinder 23, and then to the blanket cylinder 20. Blanket cylinder 20 of the last prime printing system 4, itself, does not have any grippers. Rather, the blanket cylinder 20 has transport chains located on the shaft thereof. The transport chains 30 receive the sheet from the printing cylinder 23 and transport the sheet in the direction of the arrow b to a sheet stacking terminal station—not shown. The arrangement insures that sheets, after having been taken off the blanket cylinder 20, are freely conducted at the lower run of the sheet gripper transport chain system 31, so that the still wet ink cannot smear by engagement with other components of the machine.

The arrangement, as described, is capable of four-color prime printing, and can be used as such. FIG. 1 illustrates an arrangement in which the machine can be expanded to provide not only four-color prime printing, but additionally single-color verso printing. A verso printing unit 32 is located between the engagement surfaces of the frame structures of the prime printing stations 3 and 4. The verso printing unit includes a plate cylinder 33, an inker 34, and a damper 35. The plate cylinder 33 is in contact with the printing cylinder 23 which, in this form, is a blanket cylinder which has a blanket stretched thereover. In this arrangement, each one of the sheets is printed along the printing line between the blanket cylinders 19 and 23 not only once, with prime printing and with the ink of the prime printing station 3, but additionally, and simultaneously, with verso printing. The verso printing unit 32 is located between the frame structures 36, 37, 38' which may be open frames for the printing stations 1, 2, 4; the verso printing unit 32 can be retained on its own supporting side walls, which can be constructed similar to or practically the mirror image of the respective side walls 24–27.

EMBODIMENT OF FIG. 2

Four prime printing stations 51–54 are provided, identically constructed to the printing stations 1–4 of FIG. 1. Additionally, four verso printing units 55–58 are provided, located beneath the prime printing stations 51–54. Each one of the verso printing stations can be identical to the verso printing station 32, FIG. 1. The printing cylinders 63–66, then, will be formed as blanket cylinders, cooperating with the blanket cylinders 59–62 of the prime printing stations 51–54, and thus form the blanket cylinders of the verso printing stations. All of the cylinders 59–66 are equipped with grippers G, of which only two are shown for clarity on cylinders 60, 63.

Sheets are supplied to the printig station 51 from a make-ready table 67 which has transfer grippers 68. To guide the sheets gripped by the grippers on the blanket cylinders 59 to the printing line between the cylinders 59, 63, a differential air pressure system 69 is provided, applying suction to a sheet. The suction is provided by a plurality of suction boxes, connected to a source of suction—not shown—and extending over the entire length of the blanket cylinder 59. This insures that the gripper of the blanket cylinder 59 carries sheets to the printing cylinder 63 in engagement with the suction provided by the suction device 69, and does not engage against the surface of the blanket cylinder 59, which already has been inked, before the sheet reaches the printing line. It is also possible to provide an additional compressed air jet above the transfer grippers 68, as schematically shown at 73, which directs compressed air at least approximately tangentially with respect to the blanket cylinder 59.

Figure 2:
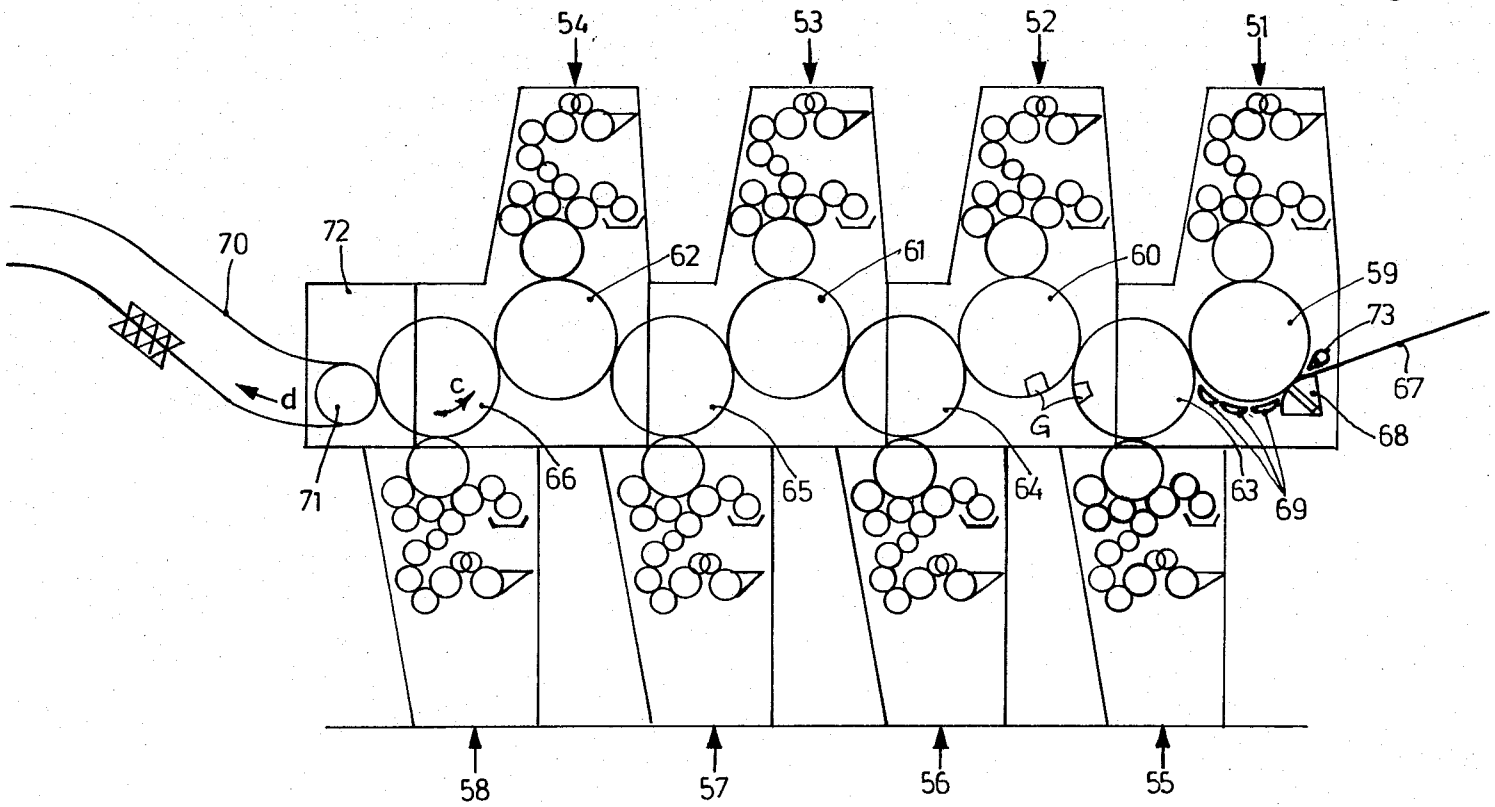

In the configuration shown in FIG. 2, the last printing station is a verso printing station. Consequently, the printing cylinder 66—in a form of a rubber blanket cylinder—is necessary to provide for printing of prime printing by the last prime printing station 54. Printing cylinder 66, which is also the blanket cylinder for the printing station 58, cooperates with a gripper chain system 70 which is guided over respective separate end rollers or sprockets 71 which are located in an attachment formed of the sprockets 71 and an end holding frame, of which only one end wall 72 is seen. This attachment receives the sheets, sequentially, from the grippers of the cylinder 66. Cylinder 66 rotates in the direction shown by arrow c. This arrangement insures that the sheets will be carried by the lower run of the gripper chain system 70 in the direction d to a supply or sheet receiving station, not shown.

Various changes and modifications may be made within the scope of the inventive concept. Any number of prime printing stations can be assembled to form a multiple prime printing, multiple color printing machine. As can be seen, compare FIG. 1, station 32, and FIG. 2, any number of verso printing units can also be constructed, and so assembled in the system that the same number of colors which are printed in prime printing can also be printed by verso printing. If the cylinders 17–20, and/or 21–23, or correspondingly 59–62 and/or 63–66, are adjustably journalled, moving them, respectively, transversely to the planes A, B, permits adjustment of contacting pressure.

I claim:

1. Sheet-fed rotary offset printing machine system having at least three first essentially identical modular printing stations (1, 2, 3, 4; 51–54) sequentially arranged in the path of feeding of the sheets, each printing station module forming a unitary assembly and comprising a plate cylinder (13; 14–16);

a blanket cylinder (17; 18–20; 59; 60–62);

an inker (5; 6–8) and a damper (9; 10–12);

all modular stations, except the last one in the sequential arrangement, further having a printing cylinder (21; 22, 23; 63; 64–66);

in which the axes of rotation of the blanket cylinders of all the modular printing stations are located in a first common plane (A), and the axes of rotation of the printing cylinders are all located in a second common plane (B), parallel to said first plane;

and wherein the blanket cylinders and the printing cylinders include sheet grippers (G);

the printing cylinder (e.g. 22) of any one modular station (e.g. 2) being in engagement with both the blanket cylinder of the station (2) of which it is a part, and with the blanket cylinder (e.g. 19) of an adjacent modular station (e.g. 3);

a theoretical connecting line (C) between the axes of rotation of any blanket cylinder and of the adjacent printing cylinder of the system has a plurality of respectively angled portions or legs defining, together, a zig-zag configuration, the individual portions or legs of which are inclined with respect to each other by an angle ($\alpha$) of between about 70° to 175°; and the sheet is transferred from the blanket cylinder of any one station to the blanket cylinder of any adjacent printing station directly by the printing cylinder between the adjacent stations.

2. System according to claim 1, wherein said angle ($\alpha$) is an obtuse angle.

3. System according to claim 1, wherein said angle ($\alpha$) is in the range of between about 100° to 150°.

4. System according to claim 1, wherein said angle ($\alpha$) is in the order of about 145°.

5. System according to claim 1, wherein said first common plane and said second common plane both extend in essentially horizontal direction.

6. System according to claim 1, wherein the diameters of the printing cylinders (21–23; 63–66) is a whole number multiple of the diameter of the plate cylinders (13–16).

7. System according to claim 1, wherein the diameters of the blanket cylinders (17–19; 59–66) are a whole number multiple of the diameters of the plate cylinders (13–16).

8. System according to claim 7, wherein the diameters of the blanket cylinders are twice the diameters of the plate cylinders.

9. System according to claim 6, wherein the diameters of the blanket cylinders (17–20; 59–66) and of the printing cylinders (21–23; 59–66) are equal.

10. System according to claim 6, wherein the diameters of the blanket cylinders (17–20; 59–66) and of the printing cylinders (21–23; 59–66) are equal.

11. System according to claim 1, wherein the system includes at least one dual modular printing station capable of providing prime and verso printing;

and wherein the printing cylinder (23; 59–66) of said at least one modular station comprises a cylinder carrying a rubber blanket to form the blanket cylinder of a verso printing station;

and said verso printing station includes a plate cylinder (33) positioned for engagement with said at least one printing cylinder carrying the rubber blanket, an inker (35) and a damper (34), the plate cylinder, inker, and damper combination forming a verso printing modular unit.

12. System according to claim 11, including frame structures (36, 37, 38) positioned to support at least some of the prime printing stations (1–4; 51–54);

and verso printing modular units (32; 55–58) located beneath and supporting others of the prime printing units.

13. System according to claim 1, wherien the printing stations provide prime printing, and wherein the blanket cylinder (20) of the last of the sequentially arranged printing stations (4) includes means for supporting a transport chain (31) for transportation of sheets from the last blanket cylinder to a delivery location.

14. System according to claim 11, wherein the printing stations include prime and verso printing modular units, and the last printing modular unit (58) applies verso printing;

further including an attachment structure (72) having transport chain sprockets (71), and a transport chain (70) receiving sheets from the last blanket cylinder (66) for transporting of printed sheets to a delivery location.

15. System according to claim 1, further including supply gripper means (29, 68) supplying the sheets to the first one of the blanket cylinders (17, 59) of the sequentially arranged printing stations.

16. System according to claim 15, further including an engagement or application roller (30) located adjacent the first one of the blanket cylinders (17) of the first printing station (1) in the direction of rotation of the blanket cylinder, and located immediately behind the supply gripper means to engage a sheet against the blanket cylinder.

17. System according to claim 15, further including differential air pressure means (69, 73) located along the path of a sheet between the supply gripper means (68) and the printing line of the first blanket cylinder (59) and positioned to space a sheet gripped by the gripper (G) of the first blanket cylinder from the surface of said first blanket cylinder.

18. System according to claim 17, wherein said differential air pressure means includes an air suction arrangement (69).

19. A sheet-fed rotary offset printing module for use in combination with at least one essentially identical printing module, said modules being sequentially, serially arranged—in the path of feeding of the sheets—adjacent each other, each module forming a unitary assembly and having spaced side walls (24; 25, 26, 27);

a plate cylinder (13; 14–16) located between the side walls;

an inker (5; 6–8) and a damper (9; 10–12);

a blanket cylinder (17; 18–20) located between the side walls and in engagement with the plate cylinder (13);

and a printing cylinder (21; 22, 23) having a rubber blanket surface, and positioned in the side walls for engagement with the blanket cylinder (17; 18–20) of an adjacent module positioned downstream in the path of feeding of the sheets, sheet grippers (G) positioned on the blanket cylinder and on the printing cylinder;

and wherein the axes of rotation of the blanket cylinder and the printing cylinder of the respective stations of the system are located along a theoretical connecting line (C) which has a plurality of respectively angled portions or legs defining, together, a zig-zag configuration, the individual portions of which are inclined with respect to each other by an angle ($\alpha$) of between 70° to 175°;

and said printing cylinder having the rubber blanket surface will, directly transfer the sheet from the blanket cylinder to the blanket cylinder of the next adjacent module.

20. Module according to claim 19, including a verso printing module, said verso printing module comprising a plate cylinder (33), an inker (35) and a damper (34);

a frame structure (36–38) supporting said verso printing module and further supporting said module thereabove;

wherein the printing cylinder (21; 22, 23) of said module carries a rubber blanket, said frame structure positioning and supporting the plate cylinder of the verso printing module in engagement with the printing cylinder of said module carrying said rubber blanket, whereby a sheet being passed between the blanket cylinder of the module and the printing cylinder of said module carrying said rubber blanket will provide, simultaneously, prime and verso printing to a sheet being fed between said blanket cylinder and said printing cylinder equipped with the rubber blanket, and said printing cylinder equipped with the rubber blanket will, simultaneously, provide for transport of the sheet to the blanket cylinder of a next adjacent module.

* * * * *